United States Patent [19]

Koh

[11] 4,218,329

[45] Aug. 19, 1980

[54] COOLING AND LUBRICATING FLUID FOR METAL WORKING

[76] Inventor: Kook-Wha Koh, 2461 Wickfield Dr., West Bloomfield, Mich. 48033

[21] Appl. No.: 937,404

[22] Filed: Aug. 28, 1978

[51] Int. Cl.[2] ..... C10M 1/54

[52] U.S. Cl. ..... 252/46.4

[58] Field of Search ..... 252/46.4

[56] References Cited

U.S. PATENT DOCUMENTS 2,147,409 2/1939 Lamprey ..... 252/5

3,719,598 3/1973 King ..... 252/33.4

3,992,306 11/1976 Diery et al. ..... 252/33.6

*Primary Examiner*—Paul F. Shaver

*Attorney, Agent, or Firm*—Harness, Dickey & Pierce

[57] ABSTRACT

A cooling and lubricating fluid for metal cutting, grinding and other machining processes comprises an aqueous solution of a salt of molybdate, a reaction product of an aromatic sulfonamidocarboxylic acid and alkanol amines, morpholine, a metal deactivator, a coupling agent, and optionally, bactericide, fungicide, chelating and extreme pressure agents.

11 Claims, No Drawings

COOLING AND LUBRICATING FLUID FOR METAL WORKING

BACKGROUND OF THE INVENTION

This invention relates to a cooling and lubricating fluid for metal cutting and grinding and other machining processes, particularly for industrial, heavy duty metal cutting and machining processes where the cooling and lubricating fluid is recycled and used over long periods of time.

During various metal working or machining processes such as cutting, surface grinding, tapping, milling, drilling and so forth, it is necessary to employ a cooling and lubricating fluid to reduce wear and minimize the generation of heat between the cutting tool and the workpiece thereby increasing the useful life of tools. It is also desirable to employ a fluid which is economical, can be recycled for long term reuse, and serves a protective function to inhibit corrosion of the workpiece and tool. Still further, it is desirable to employ a fluid which enables the production of workpieces having a smooth surface finish without stain or rust.

Various metal working lubricant fluids are known and are disclosed, for example, in the following U.S. patents. U.S. Pat. No. 2,825,693, Mar. 4, 1958 to Beaubien et al discloses an aqueous metal working lubricant comprising certain block coploymers in conjunction with corrosion inhibitors, anti-wear agents, and optionally, anti-foaming agents, coupling agents, germicidal agents, and so forth. U.S. Pat. No. 3,719,598, Mar. 6, 1973 to King discloses an aqueous cutting fluid containing the reaction product of boric acid with an aliphatic amine, together with a petroleum sulfonate of an amine or an alkyl metal, in combination with a nonionic wetting agent. The King patent further discloses that other ingredients may be used such as a reaction product of an amine and a fatty acid or sulfurized fatty acid, alkyl metal nitrite, silicone antifoaming agents, bactericides, and metal deactivators such as sodium mercaptobenzothiazole. U.S. Pats. No. 3,556,994, Jan. 19, 1971 and 3,992,306, Nov. 16, 1976 both to Diery et al disclose metal working and corrosion protection agents in the form of salts of aromatic sulfonamidocarboxylic acids and bissulfonamidocarboxylic acids respectively.

Additional corrosion inhibiting agents are also disclosed in U.S. Pat. No. 2,147,409, Feb. 14, 1939 to Lamprey, which discloses soluble salts of tungstic, silicic, and molybdic acids as corrosion inhibitors in antifreeze liquids which can also contain other known corrosion inhibitors such as triethylamine or sodium hydroxide. And U.S. Pat. No. 2,194,491, Mar. 26, 1940 to Bird et al, discloses the addition of mercaptobenzothiazole or its salts and soluble phosphites or hypophosphites to aqueous solutions for the purpose of decreasing the corrosive action of such solutions in cooling systems of internal combustion engines.

It is an object of the present invention to provide an improved cooling and lubricating fluid for industrial metal cutting and fabricating processes. Such processes require a fluid having low foaming characteristics, good resistance to rancidity as the fluid is recycled and reused over an extended period of time, nonstaining characteristics so that tools and workpieces are not blemished, and good hard water tolerance in order to be used with local water which may contain a considerable amount of mineral components. Of course, a satisfactory cooling and lubricating fluid must accomplish its primary purposes of cooling and lubricating. In addition, it is of great importance that the cooling and lubricating fluid minimize use of known toxic and irritating chemicals. In particular, it is highly desirable that the fluid avoid use of known or highly suspect carcinogenic chemicals. Recently sodium nitrite, which is commonly used in a variety of compositions including metal machining fluids, has become suspect as a potential carcinogenic chemical. Accordingly, it is one object of the present invention to provide a cooling and lubricating fluid for metal cutting and other machining processes without sodium nitrite. It is another object of the present invention to provide a fluid composition having excellent anti-corrosion characteristics with respect to both ferrous and nonferrous metal workpieces and tools. Still another object of the present invention is to provide a fluid composition capable of providing lubricant properties even under extreme pressure conditions and which has resistance to rancidity, foaming, hard water, and staining. These and other objects will be apparent from the following disclosure. All percentages and parts herein are percentages or parts by weight unless otherwise indicated.

SUMMARY OF THE INVENTION

The present invention relates to an aqueous solution for use as a cooling and lubricating fluid for metal cutting and fabricating operations. A cooling and lubricating fluid of the present invention comprises an aqueous solution of:

(a) from about 0.1 parts to about 10 parts of an inorganic corrosion inhibitor selected from the group consisting of water-soluble salts of molybdate;
(b) from about 1 part to about 70 parts of an organic corrosion inhibitor selected from the group consisting of water soluble reaction products of an aromatic sulfonamidocarboxylic acid and an amine;
(c) from about 5 parts to about 50 parts of an organic corrosion inhibitor selected from the group consisting of water-soluble amines and mixtures thereof;
(d) from about 0.3 to about 10 parts of morpholine;
(e) from about 0.1 part to about 10 parts of a metal deactivator; and
(f) from about 0.1 part to about 15 parts of a coupling agent.

Preferably, the composition of the present invention also contains a bactericide and/or fungicide, chelating agent, and extreme pressure agent. The composition can be provided in a concentrate form which is then diluted with additional water and used as a cooling and lubricating fluid in metal cutting and fabricating operations. The fluid composition, in use, can comprise from about 90% to about 99.5% water.

DESCRIPTION OF THE INVENTION

The present invention relates to a cooling and lubricating fluid composition for metal cutting and fabricating operations having an aqueous base and comprising an inorganic corrosion inhibitor, organic corrosion inhibitors, morpholine, a metal deactivator and a coupling agent. Preferably, the composition also contains a bactericide, fungicide, chelating agent, and extreme pressure agent. A fluid composition of the present invention is low foaming, resistant to rancidity, tolerant of hard water. The composition provides excellent cooling and lubricating functions and does not contain sodium nitrite which is suspected to be a potential cancer causing material yielding N-nitroso compounds and their metabolized products.

The aqueous based lubricating and cooling fluid of the present invention contains from about 0.1 parts to about 10 parts, preferably from about 2 parts to about 5 parts of an inorganic corrosion inhibitor selected from the group consisting of water-soluble salts of molybdate. Molybdate salts are employed rather than other conventional inorganic corrosion inhibitors because of their excellent performance combined with a favorable reputation with respect to toxicity. Suitable water-soluble salts of molybdate for use in the present invention include the lithium, potassium, sodium and ammonium salts of molybdate.

The organic corrosion inhibitor of the present invention comprises from about 1 part to about 70 parts of the present composition, preferably from 5 parts of about 50 parts, and is selected from the group consisting of reaction products of an aromatic sulfonamidocarboxylic acid and an amine. Suitable reaction products as well as methods of making the reaction products are disclosed in U.S. Pat. No. 3,556,994, Jan. 19, 1971 to Diery et al which is hereby specifically incorporated by reference herein. Preferably, the organic corrosion inhibitor is the reaction product of an aromatic sulfonamidocarboxylic acid and a water-soluble alkanolamine or ethoxylated fatty amine having from about 5 to about 15 othoxy moieties.

The composition of the present invention also employs an organic corrosion inhibitor consisting of a water-soluble amine or mixture thereof in an amount ranging from about 5 parts to about 50 parts, preferably from about 20 parts to about 30 parts. Preferably a mixture of water-soluble amines is used. The amine, or preferably mixture of amines provides an additional lubricity, corrosion inhibitor and a bacterial function while at the same time is low foaming. Suitable amines include alkyl-amines, alkanol-amines, fatty-amines, ethoxylated-amines, polyethoxylated-amines, polyethoxylated-diamines, and so forth. Suitable water-soluble amines for use in this invention are disclosed in U.S. Pat. No. 2,825,693, Mar. 4, 1958 to Beaubien et al which is hereby specifically incorporated by reference herein.

It has been found that a cooling and lubricating fluid of the present invention exhibits surprisingly increased corrosion inhibition characteristics when an additional inhibition agent of morpholine is employed in the composition. It is contemplated that the present invention will comprise from about 0.3 parts to about 10 parts, and preferably from about 0.5 part to about 5 parts of morpholine.

The present composition also contains from about 0.1 to about 10 parts, preferably from about 1 part to about 5 parts, of a metal deactivator such as a copper corrosion inhibitor. Suitable metal deactivators are 2-mercaptobenzothiazole, 1,2,3- benzotriazole, and tolyltriazole and so forth.

A coupling agent is also employed in the present invention in an amount of from about 0.1 parts to about 15 parts, preferably from about 1 part to about 5 parts to provide a solubilizing and antigumming function. Examples of suitable coupling agents are disclosed in the Beaubien patent, previously cited herein. Preferred coupling agents for use in the present invention are those of the glycol-ether type and diol type, such as dipropylene glycolmethyl ether. Of course, toxic or irritating coupling agents should be avoided in the present composition.

The composition of the present invention can, and preferably does, contain optional ingredients such as an extreme pressure agent should the fluid composition have an intended use involving extreme pressure conditions between the tool and workpiece. Suitable extreme pressure agents are well known in the art and include water-soluble salts of chlorine, sulfur or phosphate. Examples of suitable extreme pressure additives include quarternary ammonium trimethyltallow-ammonium chloride, sulfonated caster oil, sodium cresyl phosphate, an alkyl acid phosphate such as sodium cresyl phosphate or a dialkyl phosphite such as di-octyl phosphite.

The fluid composition of this invention also optionally and preferably contains bactericide compound, a fungicide compound, and a chelating agent. Suitable bactericides, fungicides and chelating agents for use in metal lubricating and cooling fluids are well known in the art.

The cooling and lubricating fluid of the present invention can be provided in a concentrate form and then used in metal cutting and fabricating operations after dilution with water. In concentrate form, the composition of this invention can comprise, for example, about 30 to 40% water. The concentrate can then be diluted to comprise from about 90% to about 99.5% water to provide an economical cooling and lubricating fluid for industrial or commercial use.

The following example is offered to illustrate the present invention.

EXAMPLE 1

A cooling and lubricating fluid for metal cutting and fabricating is made in accordance with the following:

First, an aqueous based fluid concentrate is prepared by mixing the following ingredients at room temperature:

| | Parts |
|---|---|
| sodium molybdate | 3 |
| morpholine | 5 |
| sodium mercaptobenzothiazole (in 50% water) | 4 |
| triethanolamine | 22 |
| salt of the reaction product of an aromatic sulfonamidocarboxylic acid with an amine (Hostacor H from American Hoechst Corp.) | 30 |
| di-propylene glycolmethyl ether | 2 |
| water | 35 |

Then, the above aqueous based fluid concentrate is diluted by the addition of water to form a cooling and lubricating fluid of the present invention for use in metal cutting and fabricating operation. Thus, 100 parts of the above composition is thoroughly mixed with an additional 5,000 parts of water to form a cooling and lubricating fluid of the present invention having excellent cooling and lubricating properties in addition to low foaming characteristics and good resistance to rancidity, and hard water tolerance. Furthermore, the fluid does not contain sodium nitrite.

EXAMPLE 2

The fluid of Example 1 is made more resistant to bacteria, fungus and hard water by the addition of one part of hexahydro-1,3,5-triethyl-s-triazine as a bactericide, 0.1 parts of sodium 2-pyradine-thiol-2-oxide as a fungicide, and 1 part of tetrasodium EDTA as a chelating agent.

What is claimed is:

1. An aqueous cooling and lubricating fluid for metal cutting and fabricating operations comprising:
(a) from about 0.1 parts to about 10 parts of an inorganic corrosion inhibitor selected from the group consisting of water-soluble salts of molybdate;
(b) from about 1 part to about 70 parts of an organic corrosion inhibitor selected from the group consisting of water soluble reaction products of an aromatic sulfonamidocarboxylic acid and an amine;
(c) from about 5 parts to about 50 parts of an organic corrosion inhibitor selected from the group consisting of water-soluble amines and mixtures thereof;
(d) from about 0.3 to about 10 parts of morpholine;
(e) from about 0.1 part to about 10 parts of a metal deactivator; and
(f) from about 0.1 part to about 15 parts of a coupling agent.

2. A fluid as recited in claim 1 wherein said organic corrosion inhibitor selected from the group consisting of water-soluble amines is selected from the group consisting of alkyl-amines, alkylolamines, fatty-amines, ethoxylated-amines, polyethoxylated amines and polyethoxylated diamines.

3. A fluid as recited in claim 2 wherein said organic corrosion inhibitor selected from the group consisting of water soluble amines is a mixture of at least two amines.

4. A fluid as recited in claim 1 wherein said metal deactivator is selected from the group consisting of 2-mercaptobenzothiazole, 1,2,3-benzotriazole and tolytriazole.

5. A fluid as recited in claim 1 wherein said coupling agent is selected from the group consisting of glycol ethers and diols.

6. A fluid as recited in claim 5 wherein said coupling agent is dipropyleneglycolmethylether.

7. A fluid as recited in claim 1 wherein said fluid contains, in addition, a bactericide, a fungicide, a chelating agent and an extreme pressure agent.

8. A fluid as recited in claim 1 wherein said water soluble salt of molybdate is sodium molybdate.

9. A fluid as recited in claim 1 wherein said organic corrosion inhibitor selected from the group consisting of water soluble amines is selected from the group consisting of monoethanolamine, diethanolamine, triethanolamine, and tri-isopropanolamine.

10. A fluid as recited in claim 1 wherein said fluid comprises:
(a) from about 2 parts to about 5 parts of sodium molybdate;
(b) from about 5 parts to about 50 parts of a corrosion inhibitor selected from the group consisting of water soluble reaction products of an aromatic sulfonamidocarboxylic acid and an amine;
(c) from about 20 parts to about 30 parts of an organic corrosion inhibitor selected from the group consisting of mixtures of water soluble amines;
(d) from about 0.5 part to about 5 parts of morpholine;
(e) from about 1 part to about 5 parts of a metal deactivator; and
(f) from about 1 part to about 5 parts of a coupling agent selected from the group consisting of glycolethers and diols.

11. An aqueous cooling and lubricating fluid for metal cutting and fabricating operations comprising:
(a) about 3 parts sodium molybdate;
(b) about 5 parts morpholine;
(c) about 4 parts sodium mercaptobenzothiazole;
(d) about 17 parts triethanolamine;
(e) about 30 parts of the reaction product of an aromatic sulfonamidocarboxylic acid and an amine; and
(f) about 2 parts of di-propyleneglycolmethylether.

* * * * *